US006935077B2

(12) United States Patent
Wulfert et al.

(10) Patent No.: US 6,935,077 B2
(45) Date of Patent: Aug. 30, 2005

(54) EARTHQUAKE-IMMUNE CURTAIN WALL SYSTEM

(76) Inventors: Heinrich Wulfert, P.O. Box 854, State College, PA (US) 16804; Richard A. Behr, P.O. Box 854, State College, PA (US) 16804

( * ) Notice: Subject to any disclaimer, the term of this patent is extended or adjusted under 35 U.S.C. 154(b) by 0 days.

(21) Appl. No.: 10/628,808

(22) Filed: Jul. 28, 2003

(65) Prior Publication Data

US 2004/0016185 A1 Jan. 29, 2004

Related U.S. Application Data

(63) Continuation of application No. 09/093,454, filed on Jun. 8, 1998, now Pat. No. 6,598,359.

(51) Int. Cl.[7] ..... E04B 1/98; E04B 2/96

(52) U.S. Cl. ..... 52/167.1; 52/235; 52/469

(58) Field of Search ..... 52/167.1, 460, 52/469, 167.3, 235, 396.1, 396.06, 511

(56) References Cited

U.S. PATENT DOCUMENTS 2,416,240 A * 2/1947 Strandlund ..... 52/396.1
4,453,355 A * 6/1984 Stoakes ..... 52/235
4,506,482 A * 3/1985 Pracht et al. ..... 52/235
5,155,958 A * 10/1992 Huff ..... 52/235
6,170,214 B1 * 1/2001 Treister et al. ..... 52/511
6,339,906 B1 * 1/2002 Ginet et al. ..... 52/235

* cited by examiner

*Primary Examiner*—Michael Safavi
(74) *Attorney, Agent, or Firm*—Wood, Phillips, Katz, Clark & Mortimer

(57) ABSTRACT

Described herein is a curtain wall system for multi-story buildings that is highly resistant to the damage caused by multidirectional swaying motions in building frames during an earthquake. In a conventional curtain wall system, each story is connected structurally to the stories above and/or below it. Earthquake-induced swaying motions of the building frame cause significant load transfers from story to story and cause such a conventional curtain wall system to be susceptible to earthquake damage. Not only does this damage necessitate expensive repairs, but serious threats to life safety are imposed when debris falls from a damaged wall system. In contrast, each story of the earthquake-immune curtain wall system is structurally isolated (i.e., decoupled) from adjacent stories, which produces the beneficial effects of minimizing wall system damage and the attendant risks of falling debris (in the forms of broken glass, stone, concrete, etc.) during an earthquake.

20 Claims, 11 Drawing Sheets

EARTHQUAKE-IMMUNE CURTAIN WALL SYSTEM

This application is a continuation of U.S. application Ser. No. 09/093,454 filed Jun. 8, 1998, now U.S. Pat. No. 6,598,359.

FIELD OF THE INVENTION

This invention relates to a curtain wall system for multi-story buildings and, more particularly, to a wall system that is resistant to damage caused by swaying motions of buildings during an earthquake.

BACKGROUND OF THE INVENTION

Curtain wall systems are exterior wall systems on multi-story buildings that are made of appropriate cladding materials (e.g., glass, aluminum, stone, concrete, etc.) and which carry no superimposed vertical (gravity) loads. Hence, the term "curtain" implies that a curtain wall system is essentially "hung like a curtain" from the primary structural frame of the building. A curtain wall system does not, by itself, help a building stand erect.

Although curtain wall systems are normally considered to be "non-structural" parts of a building, such terminology is misleading because curtain walls must have the ability to withstand structural loads imposed by natural phenomena such as earthquakes and severe windstorms. In this context, the term "curtain wall" is a misnomer because non-structural parts of a building can be subjected to structural loads. This invention focuses on a curtain wall system that is highly resistant to the potentially damaging effects of earthquake-induced movements of building frames.

Many curtain wall systems are constructed with glass window elements glazed within an assemblage of aluminum framing members. Architectural glass, due to its brittle nature, is inherently vulnerable to curtain wall movements during earthquakes. Research studies have been conducted to investigate the seismic performance of various types of architectural glass elements held within various aluminum curtain wall framing systems using various glazing systems. Among the findings of these studies were the following: (1) architectural glass is vulnerable to damage and fallout under simulated earthquake conditions; (2) horizontal, in-plane racking movements of a curtain wall frame constitute the primary cause of glass damage and glass fallout under simulated earthquake conditions; (3) different types of architectural glass exhibit different degrees of resistance to glass fallout under simulated seismic conditions; and (4) flexural stiffness of aluminum framing members has an influence on the susceptibility of architectural glass to seismic damage (i.e., under simulated seismic conditions, stiffer curtain wall frames are associated with more glass damage and glass fallout than are more flexible frames).

Architectural glass is not the only type of curtain wall element that is vulnerable to fracture and fallout under earthquake conditions. Curtain wall systems comprised of any rigid, brittle elements such as stone panels, cementitious panels, etc. are also potentially vulnerable to the damaging effects of earthquake-induced building motions.

The primary factors causing earthquake-induced damage of conventional curtain wall systems are: (1) movements of the building's primary structural frame in response to earthquake ground movements; and (2) the fact that vertical framing members (mullions) in conventional curtain wall systems are connected structurally to more than one floor of the primary structural frame.

The present invention is directed to solving one or more of the problems discussed above in a novel and simple manner.

SUMMARY OF THE INVENTION

In accordance with the invention there is provided a curtain wall system in which curtain frame panels of each floor are not fixedly connected to curtain wall panels of adjacent floors.

Broadly, there is disclosed herein an earthquake-immune exterior wall system for use with a multi-story building structure. The wall system includes a plurality of anchor means for connecting the wall system to the building structure, each anchor means adapted to being fixedly connected to the building structure for a single story of the multi-story building structure. Connecting means are provided for connecting each of a plurality of first elongate members directly to only one of the anchor means so that each first elongate member is fixedly connected to a single story of the multi-story building structure. A plurality of second elongate members are connected between adjacent pairs of first elongate members. The first and second elongate members collectively define panel hanging areas. A plurality of exterior cladding panels are secured to the first and second elongate members at the panel hanging areas to define the exterior wall system of the building structure.

It is a feature of the invention that the anchor means comprises steel anchor frames. Each anchor frame is rectangular in configuration and is constructed of tubular steel. The connecting means comprises anchor brackets connecting each first elongate member to upper and lower horizontal members of the anchor frames.

It is another feature of the invention that the first elongate members comprise vertical mullions.

It is an additional feature of the invention that the second elongate members comprise horizontal mullions.

It is yet another feature of the invention to provide flexible means for connecting the first and second elongate members connected to any one story to first and second elongate members connected to the story immediately above the one story. The flexible means comprises a flexible gasket of polymeric material.

There is disclosed in accordance with a further aspect of the invention an earthquake-immune curtain wall system for use with a multi-story building structure. The wall system comprises a plurality of anchor means for connecting the wall system to the building structure. Each said anchor means is adapted to being fixedly connected to the building structure for a single story of the multi-story building structure. Connecting means connect each of a plurality of vertical mullions directly to only one of the anchor means so that each vertical mullion is fixedly connected to a single story of the multi-story building structure. A plurality of horizontal mullions are connected between adjacent pairs of vertical mullions. The vertical and horizontal mullions collectively define panel frames for each story. A plurality of exterior cladding panels are secured to the vertical and horizontal mullions at the panel frames to define the exterior curtain wall system of the building structure.

It is a feature of the invention that each panel frame further includes intermediate horizontal mullions to define plural subframes and an exterior cladding panel is secured at each subframe.

This invention relates to a curtain wall system for multi-story buildings that is highly resistant to the damage caused by multidirectional swaying motions in building frames during an earthquake. In a conventional curtain wall system, each story is connected structurally to the stories above and/or below it. Interstory relative movements resulting from earthquake-induced swaying motions of the building frame cause significant load transfer from story to story and cause such a conventional curtain wall system to be susceptible to earthquake damage. Not only does this damage necessitate expensive repairs, but serious threats to life safety are imposed when debris falls from a damaged wall system. In contrast, each story of the newly invented earthquake-immune curtain wall system is structurally isolated (i.e., decoupled) from adjacent stores, which produces the beneficial effects of minimizing wall system damage and the attendant risks of falling debris (in the forms of broken glass, stone, concrete, etc.) during an earthquake.

The earthquake-immune curtain wall system achieves structural isolation of each story by employing a newly developed "seismic decoupler joint" between each story and a newly developed structural support system for vertical mullions in the wall system frame. As a result, relative movements between adjacent stories in the building frame transfer no significant forces between adjacent stores in the curtain wall frame. This invention embodies a curtain wall system that is essentially "immune" from the effects of earthquake-induced building frame motions.

DETAILED DESCRIPTION OF THE INVENTION

Figure 1A:
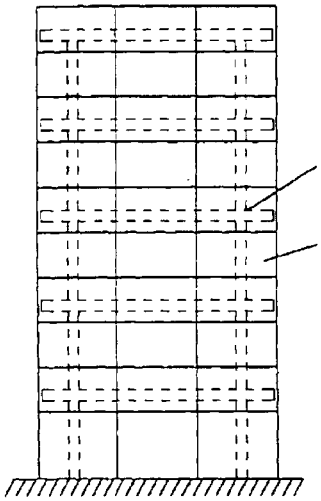
FIGS. 1A–1C are a schematic depiction of the displacement response of a typical building frame having a conventional curtain wall system to earthquake-induced ground motions.
Figure 1B:
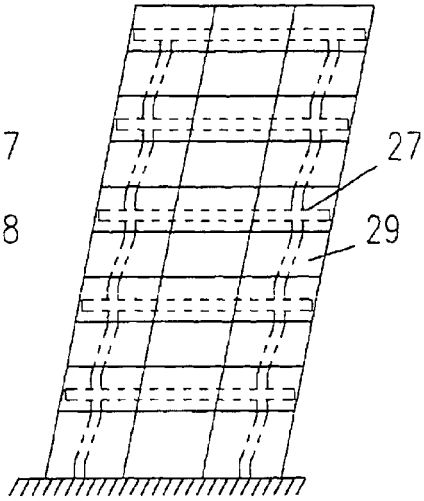
Figure 1C:
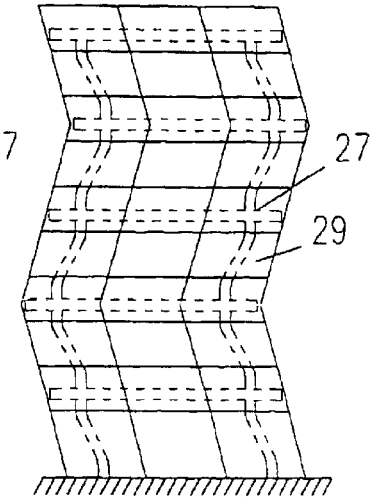

Typical swaying motions of a conventional building frame 27 in response to earthquake-induced ground movements are shown schematically in FIGS. 1A, 1B and 1C. Particularly, FIG. 1A illustrates the building frame 27 in a normal, vertical position. FIG. 1B illustrates the building frame 27 in a first mode response. FIG. 1C illustrates the building frame 27 in a second mode response. Specific mode shapes of the building frame are affected by the flexural stiffness of the floor system relative to that of the columns. Regardless of the specific mode shape, interstory drift (the difference in horizontal displacement between adjacent stories in the building frame) is a primary cause of earthquake damage in conventional curtain wall systems. Earthquakes of low to moderate magnitude can cause expensive curtain will damage and loss of building envelope weather-resistant seals. More severe earthquakes can, in addition to the aforementioned damage and loss of serviceability, impose hazards to life safety if damaged curtain wall fragments fall from the building frame.

Figure 2:
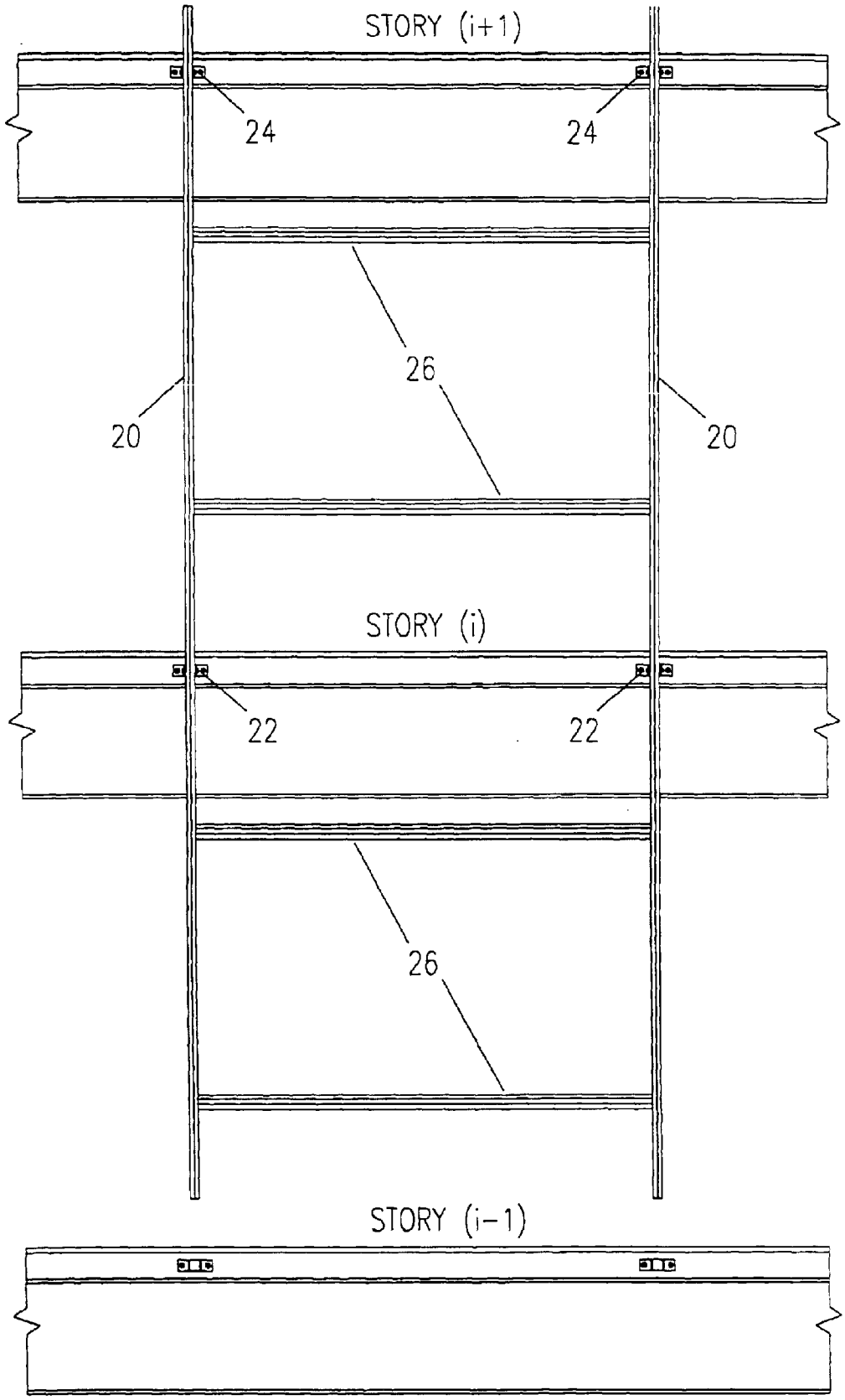
FIG. 2 PRIOR ART
FIG. 2 illustrates a typical framing and anchorage configuration of a conventional curtain wall system.

Interstory drift can cause damage in curtain wall systems because vertical framing members in conventional curtain wall systems are connected structurally to more than one floor of the primary structural frame, as depicted in FIG. 2. For example, vertical mullions 20 are connected at anchors 22 to the building structure for "Story (i)" and at anchors 24 to the building structure for "Story (i+1)". Horizontal mullions 26 are connected between adjacent pairs of vertical mullions 20. Rectangular curtain wall panels or rectangular curtain wall frame units 28, see FIG. 1A, are connected between each pair of adjacent vertical mullions 20 and horizontal mullions 26.

As illustrated in FIGS. 1B and 1C, such rectangular curtain wall panels or rectangular curtain wall frame units 28 are forcibly distorted into parallelograms 29 as a result of interstory drift when the curtain wall system at a given floor level is connected structurally to adjacent stories of the building frame. This forcible distortion of rectangular shapes into parallelogram shapes can cause frame-to-cladding panel contact, which can result in fracture of brittle cladding elements (e.g., architectural glass panels, stone cladding panels, precast concrete cladding panels, etc.) secured within the curtain wall system.

Figure 3:
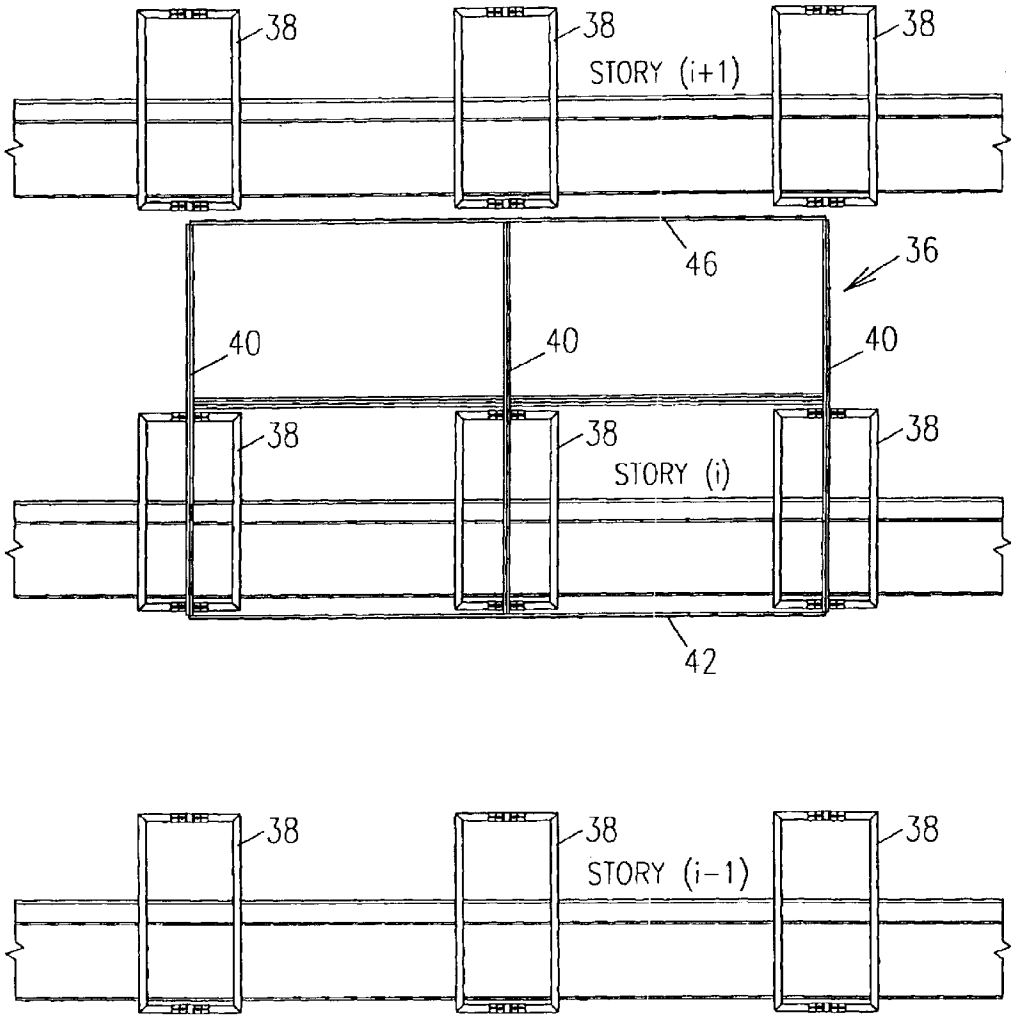
FIG. 3 illustrates a front elevation view, in various stages of assembly, of an earthquake-immune curtain wall system according to the invention.
Figure 4:
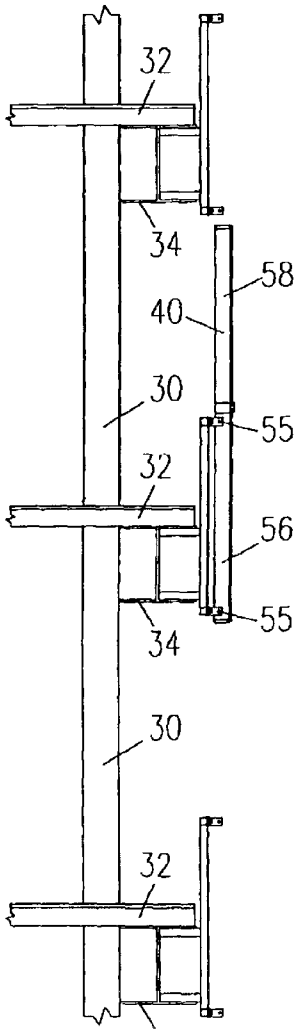
FIG. 4 is a side view of the curtain wall system of FIG. 3.

In accordance with the invention, vertical mullions are attached to only one story of the building frame, as depicted in FIGS. 3 and 4. The essence of the invention is to "decouple" (disengage) each story of the curtain wall system from adjacent stories, thereby permitting free movement of each story of the curtain wall system with respect to adjacent stories. By so doing, no significant loads are transferred between adjacent stories of the curtain wall system when the main building frame undergoes swaying motions under earthquake conditions. The result is a curtain wall system that is highly resistant to earthquake conditions.

Figure 1D:
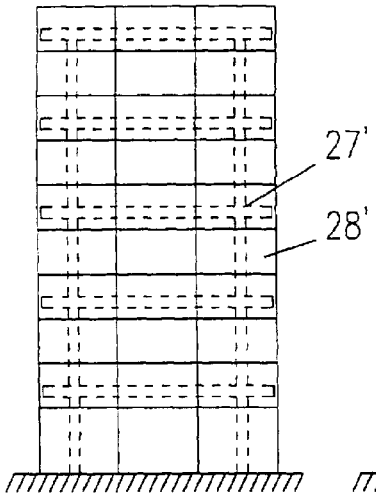
FIGS. 1D–1F are a schematic depiction of the displacement response of a building frame having an earthquake-immune curtain wall system according to the invention to earthquake-induced ground motions.
Figure 1E:
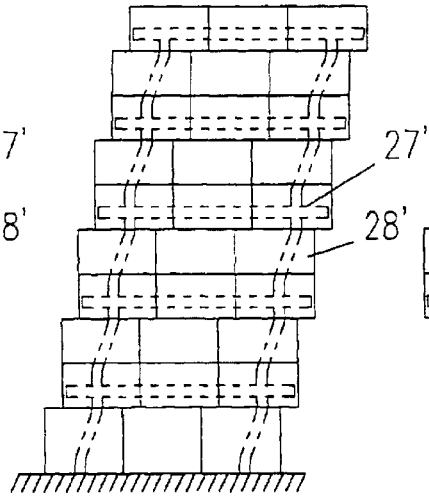
Figure 1F:
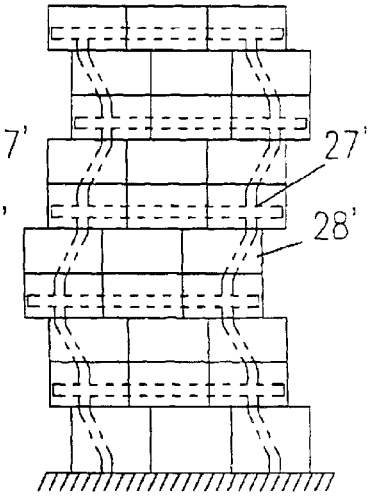

Typical swaying motions of a building frame 27' having an earthquake immune curtain wall system in response to earthquake-induced ground movements are shown schematically in FIGS. 1D, 1E and 1F. Particularly, FIG. 1D illustrates the building frame 27' in a normal, vertical position. FIG. 1E illustrates the building frame 27' in a first mode response. FIG. 1F illustrates the building frame 27' in a second mode response. As illustrated in FIGS. 1E and 1F, rectangular curtain wall panels or rectangular curtain wall frame units 28' remain rectangular even with interstory drift when the curtain wall system at a given floor level is structurally decoupled from adjacent stories of the building frame. This result can be compared to the conventional curtain wall system depicted in corresponding FIGS. 1A–1C.

FIGS. 3 and 4 illustrate building structure of a typical multi-story building including vertical columns 30 operatively connected to individual floors 32 and associated spandrel beams 34. Building structure for three floors or stories identified as "Story(i–1)", "Story(i)", and "Story (i+1)", is illustrated. As is apparent, the building can have any number of floors. A curtain wall system in accordance with the invention is defined by plural curtain wall panel frames, one of which 36 is shown, connected to each story. Plural steel anchor frames 38 are connected to the spandrel beams 34, as discussed below. The panel frames 36 are connected to the anchor frames 38. The panel frame includes plural elongate vertical framing members or mullions 40, three of which are illustrated, connected to the anchor frames 38. Connected to the vertical mullions 40 are respective lower horizontal mullions 42, intermediate horizontal mullions 44, and upper horizontal mullions 46. The particular sizes of the mullions 40, 42, 44 and 46 are dependent on the particular 10 building requirement, as well as sizes of cladding panels to be connected therebetween, as discussed below. Also, depending on panel size, the intermediate horizontal mullions 44 may be omitted. In the illustrated embodiment of the invention the mullions are formed of extruded aluminum. Each panel frame 36 is defined by the upper and lower horizontal mullions 46 and 42 and the outermost of the vertical mullions 40. Any intermediate vertical mullions 40 or the intermediate horizontal mullions 44 divide the panel frame 36 into smaller panel frames or subframes.

Figure 5:
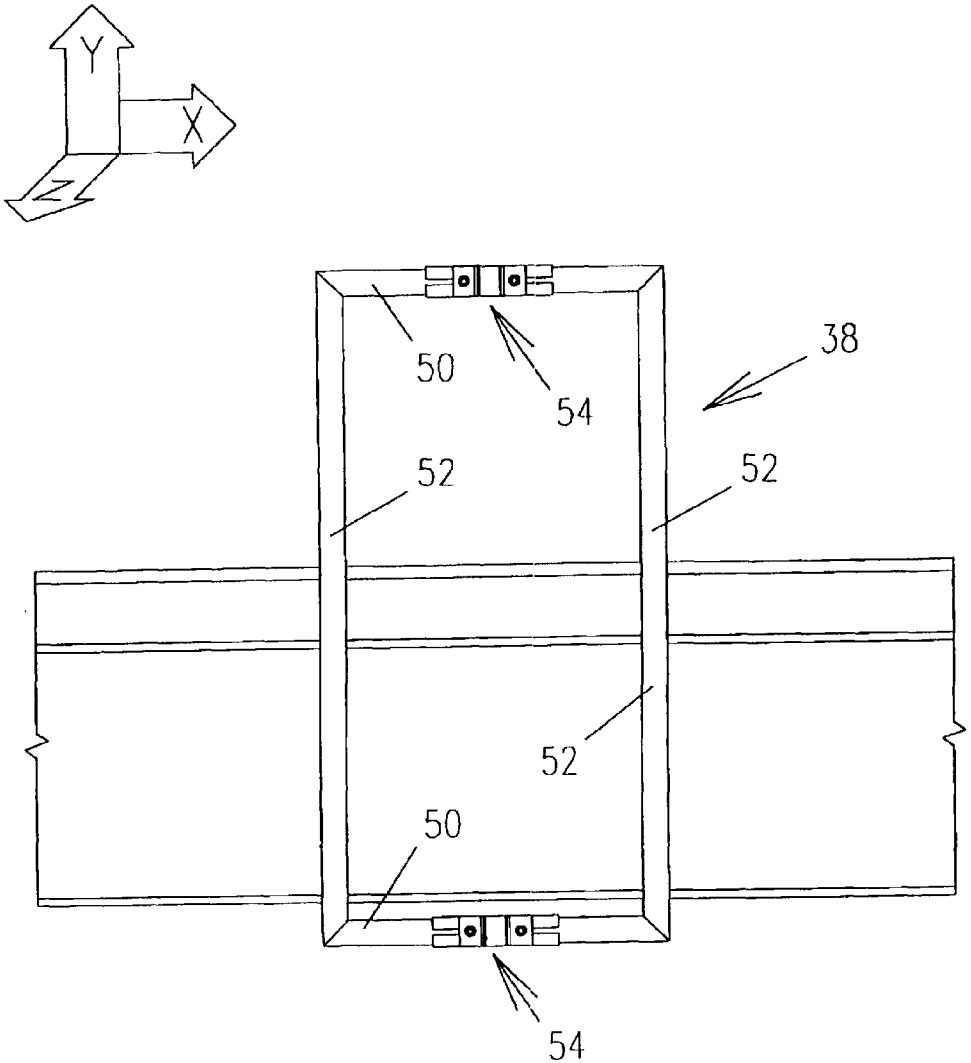
FIG. 5 is a front elevation view of a steel anchor frame for the curtain wall system according to the invention.
Figure 6:
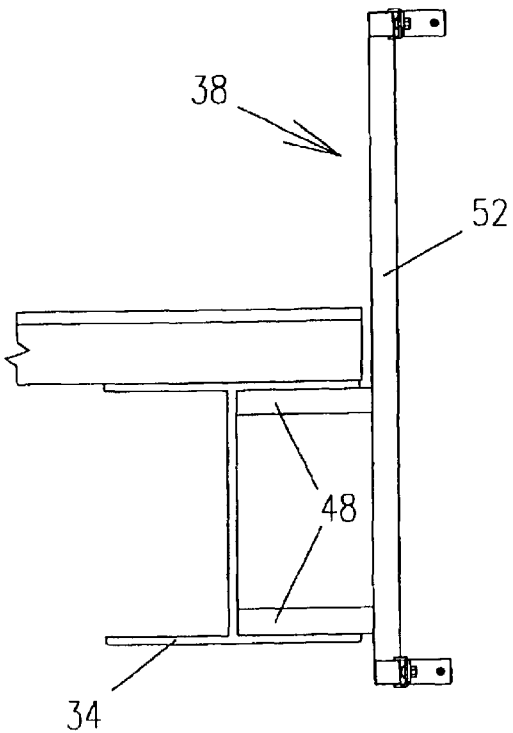
FIG. 6 is a side elevation view of the steel anchor frame of FIG. 5.
Figure 7:
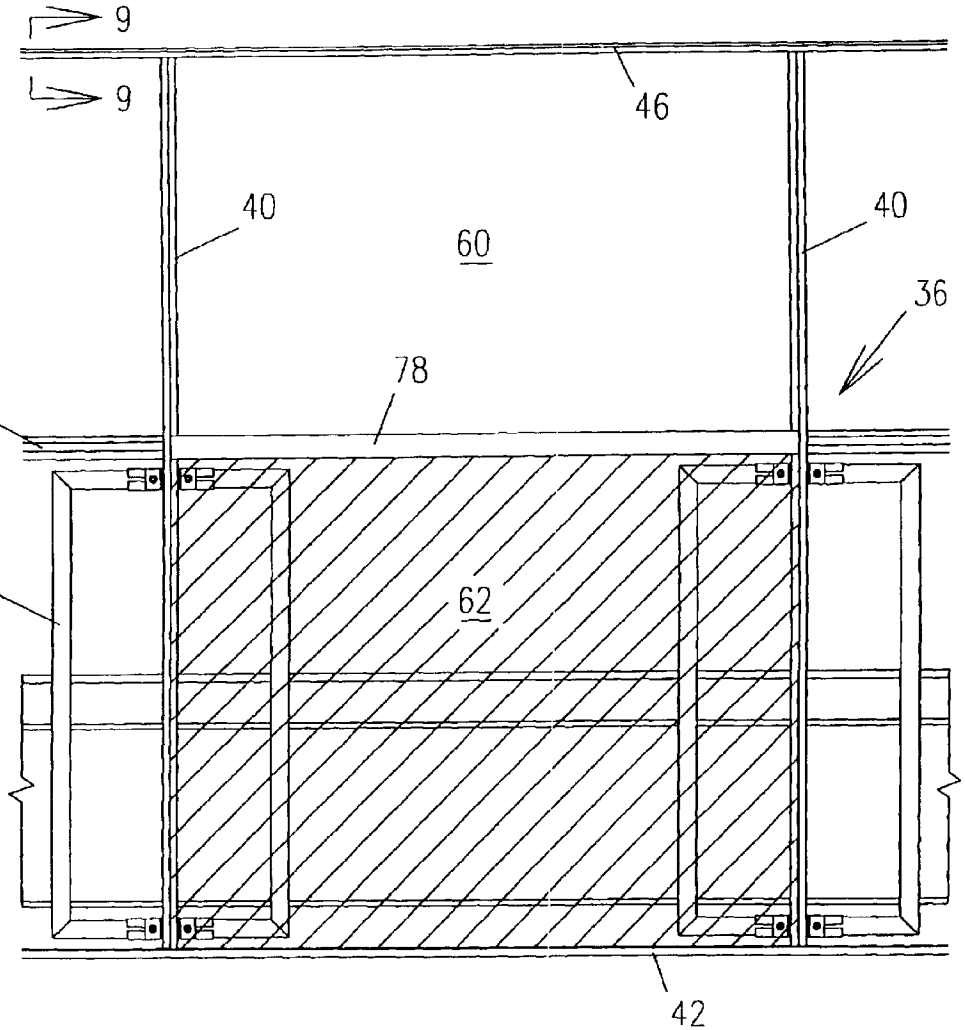
FIG. 7 is a front elevation view of a portion of a panel frame of the curtain wall system according to the invention including vision panels and spandrel panels.
Figure 15:
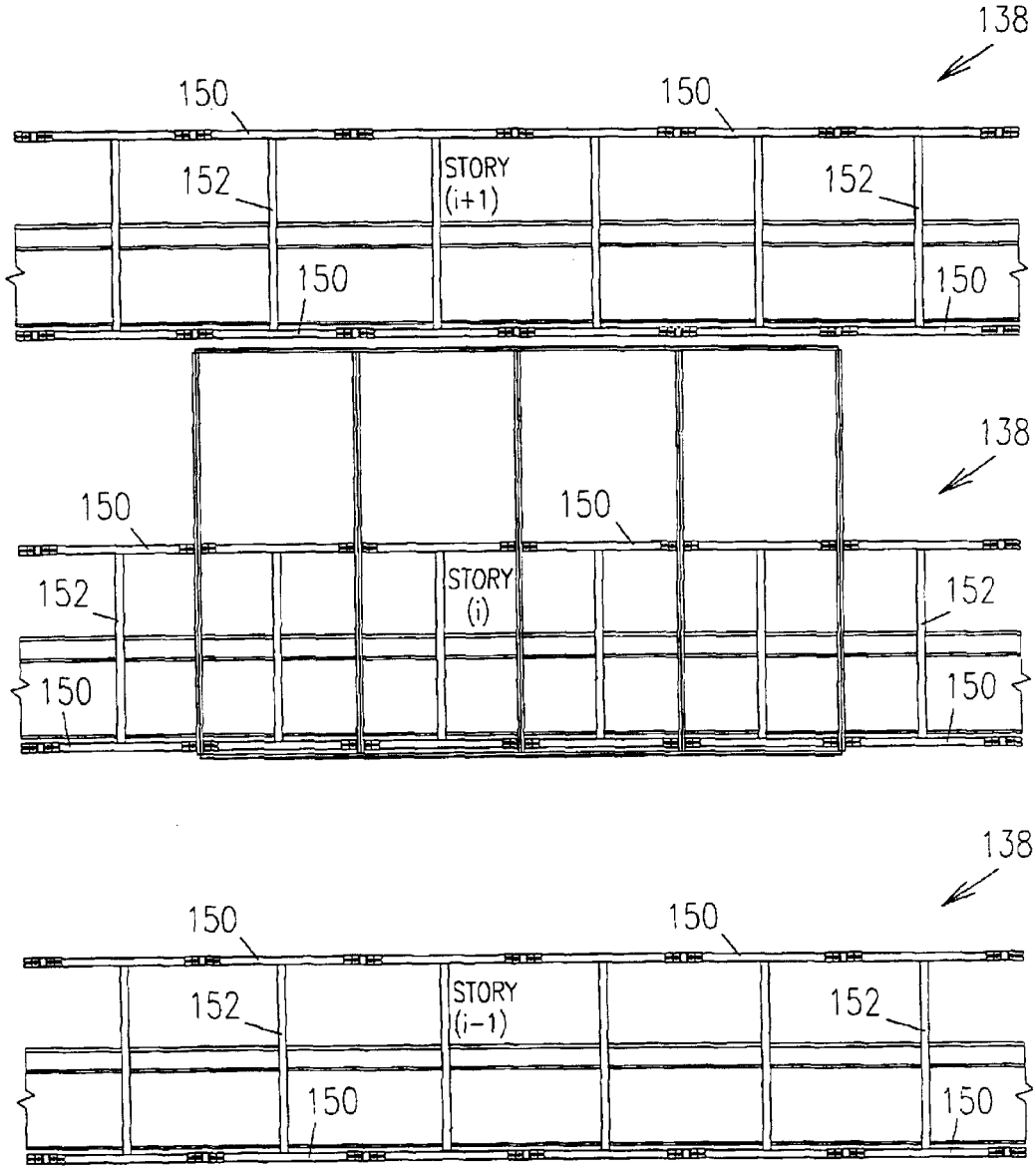
FIG. 15 is a front elevation view of a steel anchor frame for the curtain wall system according to an alternative embodiment of the invention.

Referring to FIGS. 5, 6 and 7, the steel anchor frames 38 are illustrated in greater detail. Each frame 38 is connected to a spandrel beam 34 at each story level in the main building structure using connection bars 48 secured as necessary to the spandrel beam 34. Each anchor frame 38 is connected to the spandrel beam at two locations to provide stability of the anchor frame 38 against rotation about X, Y, or Z orthogonal axes, as shown in FIG. 5. Each anchor frame is typically constructed of horizontal and vertical tubular steel members 50 and 52, respectively, in a rectangular configuration with sufficiently large cross sections to provide adequate strength and bending stiffness to resist design wind loads. Because wind loads are site specific, required cross sections of the anchor frames are determined by structural engineering design for wind loads as appropriate for each specific building site and each location on the building envelope. Alternatively, plural anchor frames 38 could be replaced with a single unit 138 consisting of elongate horizontal members 150 connected with plural spaced vertical members 152, see FIG. 15.

Referring to FIG. 5, each steel anchor frame 38 has two anchor brackets 54 at locations that provide for pin supports via bolted connections to each vertical mullion 40. Each anchor bracket 54 is centrally located at the opposite horizontal tubular steel members 50. Vertical mullions 40 are connected to the steel anchor frames 38, as shown at 55 in FIG. 4. As a result, each vertical mullion 40 has a simply supported portion 56 between the anchor brackets 54 and a cantilever portion 58 above the uppermost anchor bracket 54.

The lower, intermediate, and upper horizontal mullions 42, 44 and 46 are secured mechanically to vertical mullions 40 supported in the steel anchor frames 38 as shown in FIG. 7. With the aluminum curtain wall framing thus in place, vision panels 60 and spandrel panels 62 of any appropriate construction are secured to the curtain wall frame 36 by an appropriate glazing system or perimeter anchorage technique. For the purposes of illustration in this example, a combination of structural silicone glazing and dry glazing gaskets is employed to secure vision panels 60 and spandrel panels 62 to the curtain wall frame 36. Again, it should be noted that the selection of cladding material and the selection of glazing system is at the discretion of the designer and is not an intrinsic part of the earthquake-immune curtain wall system.

Figure 8:
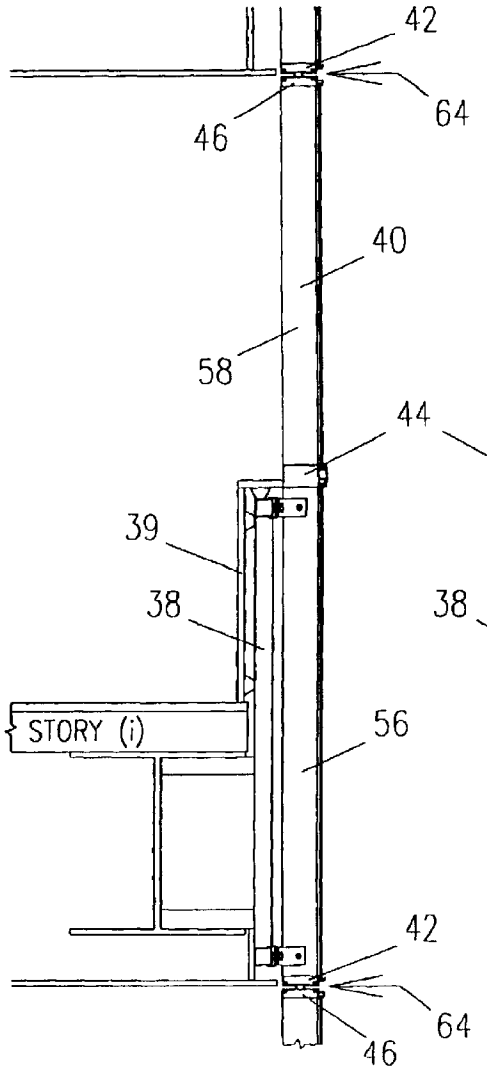
FIG. 8 is a side view of the panel frame of FIG. 7 also illustrating a seismic decoupler joint.

Connections between the horizontal mullion 42, 44 and 46 and the vertical mullions 40 are the same as those in conventional curtain wall systems. Required cross sections of all vertical and horizontal mullions are determined by structural engineering design for site-specific wind loads. Unlike the conventional curtain wall system illustrated in FIG. 2 the vertical mullions 40 according to the invention are not secured by mechanical attachment to adjacent stories (i.e., Story (i+1) and/or Story (i–1)). This structural decoupling is accomplished by means of continuous seismic decoupler joints 64 along the top surface of the upper horizontal mullion 46 and the bottom surface of the lower horizontal mullion 42 as shown in FIG. 8. By means of this configuration, relative movements of adjacent stories in the main building frame (such as those caused by earthquakes) transfer no significant loads from story to story. It should also be noted that, for maximum seismic resistance, the earthquake-immune curtain wall system should not be connected directly to interior ceiling elements, and that the ceiling of Story (i) should be attached to the underside of the floor structure of Story (i+1).

The interior facing side of the steel anchor frames 38 can also serve as a convenient and stable surface upon which interior architectural coverings 39 can be affixed in the spandrel area of Story (i), as shown in FIG. 8.

Figure 9:
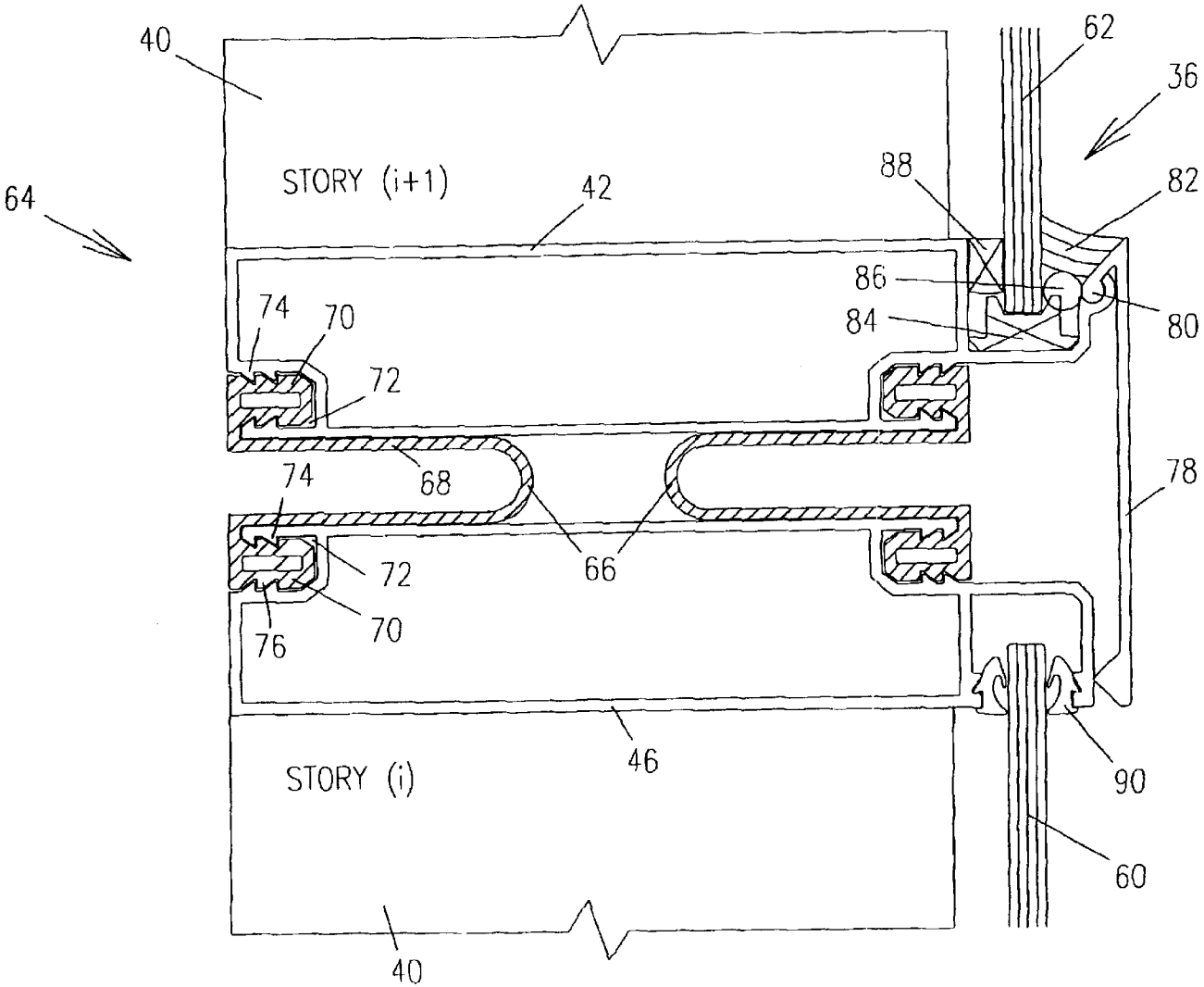
FIG. 9 is a vertical section taken along the line 9—9 of FIG. 7 illustrating the seismic decoupler joint according to the invention.

A vertical section of the seismic decoupler joint 64 is shown in FIG. 9. The decoupler joint uses a pair of continuous, flexible gaskets 66 made of polymeric material that accommodates in-plane, out-of-plane, and vertical movements between adjacent stories of the main building frame under earthquake conditions.

Each gasket 66 is made of an elongate, extruded flexible material that may span the entire width of a floor. In cross section, each gasket includes a central portion 68 connected between locking end portions 70. The central portion 68 is originally flat. When installed, the central portion is rolled into position and assumes a U-shape, as illustrated in FIG. 9. The locking end portions 70 are force-fit into channels 72 provided in the lower horizontal mullions 42 and upper horizontal mullions 46, as shown. The channels 72, in cross section, include teeth 74 for lockably engaging corresponding notches 76 in each locking end portion 70. As shown, a flexible gasket is placed at both the front and rear of adjacent lower horizontal mullions 42 and upper horizontal mullions 46. As a result, the central portions 68 extend inwardly between the lower horizontal mullion 42 of Story (i+1) and the adjacent upper horizontal mullion 46 of Story (i).

The seismic decoupler joint 64 also includes a rotation-accommodating face cap 78 that accommodates movement by means of a face cap hinge 80 and the use of a bead 82 of glazing sealant, e.g., structural silicone or other appropriate material, that has high deformation capability. This bead 82 of glazing sealant is located along the lower edge of the cladding panel, such as the spandrel panel 62, as shown in FIG. 9. When the face cap hinge 80 rotates counterclockwise, the sealant 82 is compressed, as shown in FIG. 11B. If the face cap hinge 80 were to be rotated clockwise, then the sealant 82 would be stretched. However, as will be described later, the glazing sealant bead 82 adjacent to the rotating face cap hinge 80 will see only compression (and not tension) as a result of horizontal, out-of-plane, relative movements between adjacent stories of the main building frame under earthquake-induced motions.

The cladding panels 60 and 62 are otherwise sealed in the curtain wall frame 36 using, for example, setting blocks 84, backer rods 86, glazing tape 88, and glazing gasket 90, as is conventional.

Detailed depictions of how the seismic decoupler joint accommodates in-plane, out-of-plane, and vertical interstory movements are shown in the drawing figures, as described below. The continuous, flexible gaskets 66 within the seismic decoupler joint 64 also provide thermal insulation and a weather seal between adjacent stories of the building.

Figure 10A:
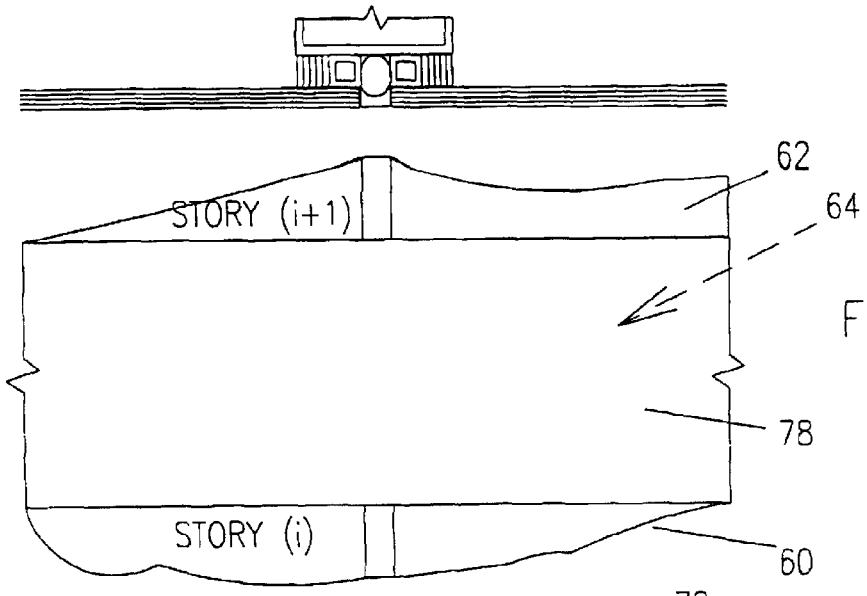
FIGS. 10A–10C illustrate front views of the seismic decoupler joint during horizontal, in-plane, interstory movements of a building frame under earthquake conditions.
Figure 10B:
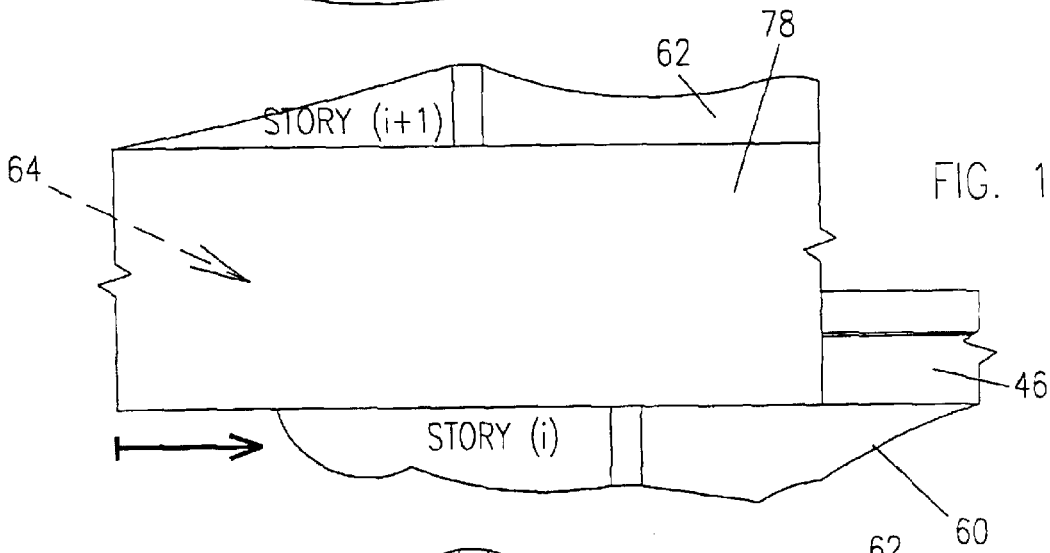
Figure 10C:
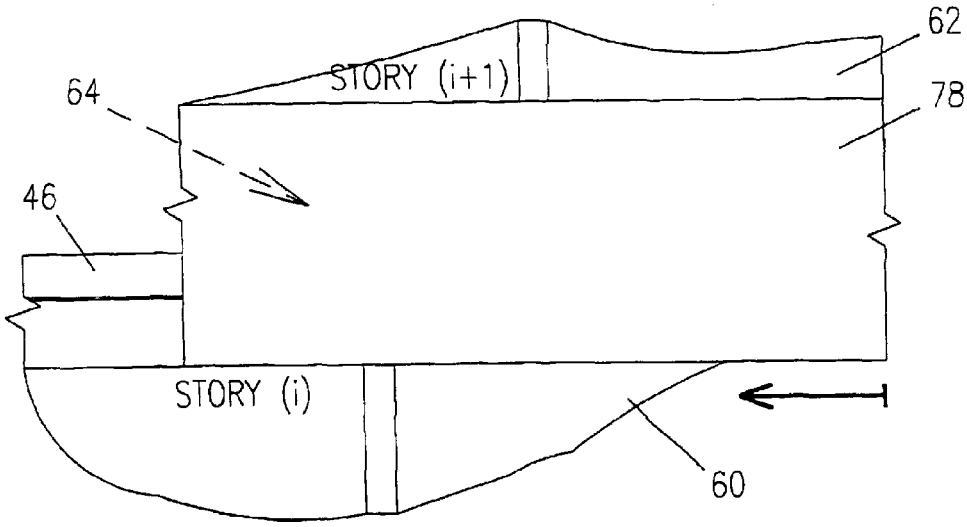

FIGS. 10A, 10B and 10C illustrate a front view of operation of a segment of the seismic decoupler joint 64 in the following positions: (1) in its normal position (FIG. 10A); (2) when Story (i) moves horizontally in-plane to the right relative to Story (i+1) (FIG. 10B); and (3) when Story (i) moves horizontally in-plane to the left relative to Story (i+1) (FIG. 10C). Horizontal, in-plane interstory movements are accommodated by the seismic decoupler joint 64, located between each story, which prevents the transfer of any significant loads between stories of an earthquake-immune curtain wall system.

Figure 11A:
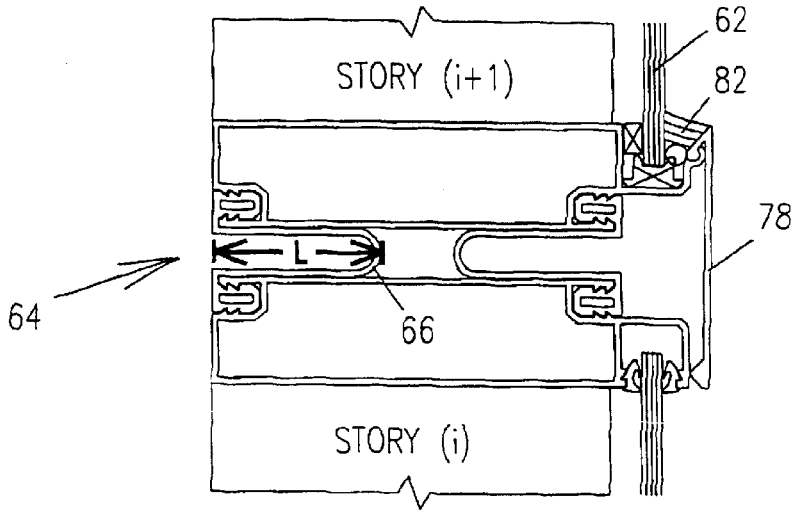
FIGS. 11A–11C are vertical sections depicting positions of the seismic decoupler joint during horizontal, out-of-plane, interstory movements of a building frame under earthquake conditions.
Figure 11B:
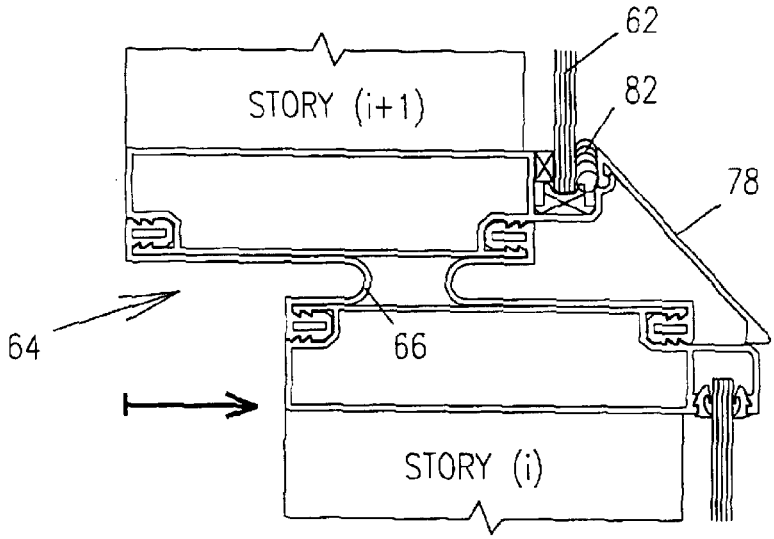
Figure 11C:
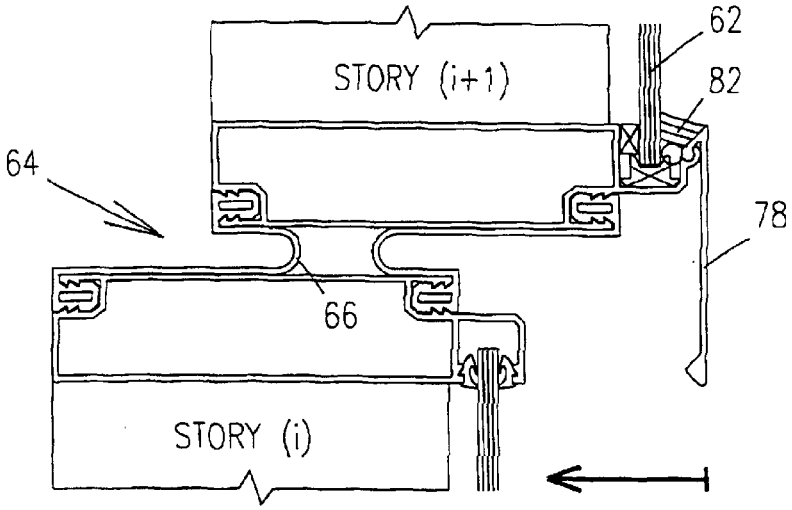

FIGS. 11A, 11B and 11C illustrate a vertical section of the seismic decoupler joint 64 in the following positions: (1) in its normal position (FIG. 11A); (2) when Story (i) moves horizontally out-of-plane outward (i.e., outward from the building face) relative to Story (i+1) (FIG. 11B); and (3) when Story (i) moves horizontally out-of-plane inward relative to Story (i+1) (FIG. 11C). Horizontal, out-of-plane, interstory movements are accommodated without stressing the continuous flexible gasket 66 in the seismic decoupler joint 64—provided that the magnitude of the relative movement is less than approximately the total length of each individual strip of gasket 66 in the seismic decoupler joint 64, or approximately twice the length "L" in FIG. 11A. Out-of-plane movements in excess of approximately the length 2L would stretch the flexible gaskets 66 (and possibly tear them), but there would still be no significant amount of interstory load transfer in the curtain wall system. It is also shown in FIGS. 11B and 11C that the sealant bead 82 at the bottom of the Story (i+1) cladding panel is compressed, but is not stretched, as a result of horizontal, out-of-plane, interstory movements.

Figure 12A:
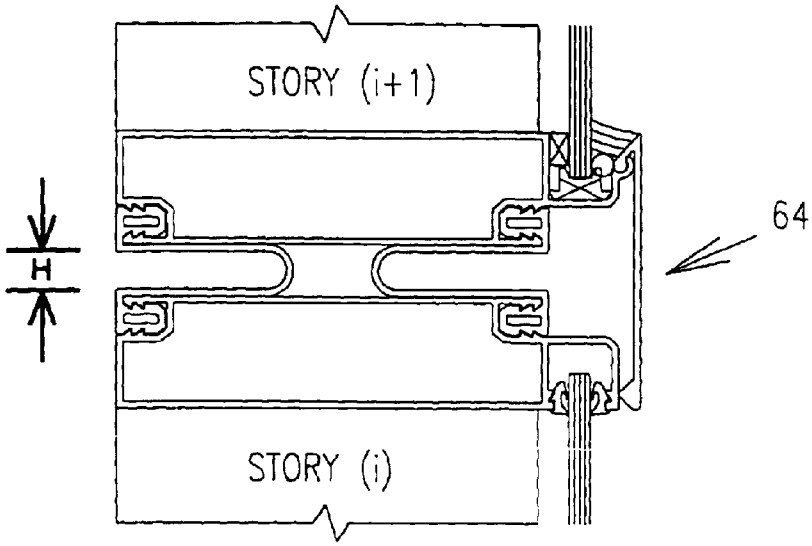
FIGS. 12A–12C are vertical sections depicting positions of the seismic decoupler joint during vertical, interstory movements of a building frame under earthquake conditions.
Figure 12B:
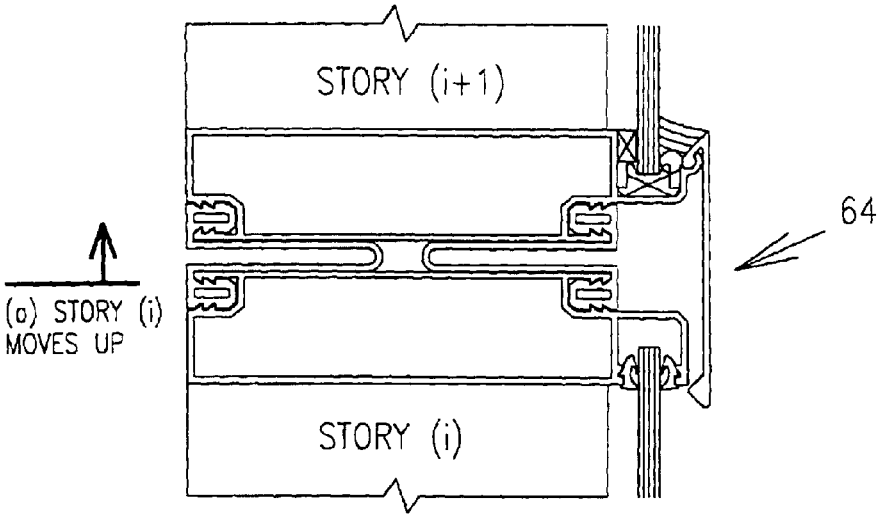
Figure 12C:
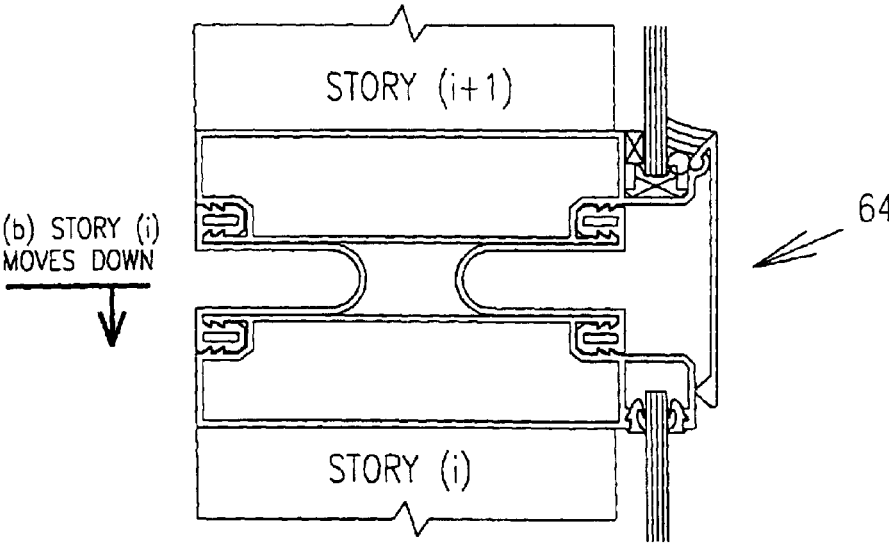

FIGS. 12A, 12B and 12C illustrate a vertical section of the seismic decoupler joint 64 in the following positions: (1) in its normal position (FIG. 12A); (2) when Story (i) moves vertically upward relative to Story (i+1) (FIG. 12B); and (3) when Story (i) moves vertically downward relative to Story (i+1) (FIG. 12C). Vertical interstory relative movements are accommodated without vertical interstory load transfer, provided that the relative vertical movement does not exceed the vertical gap built into the seismic decoupler joint 64, or the distance "H" in FIG. 12A.

Figure 13:
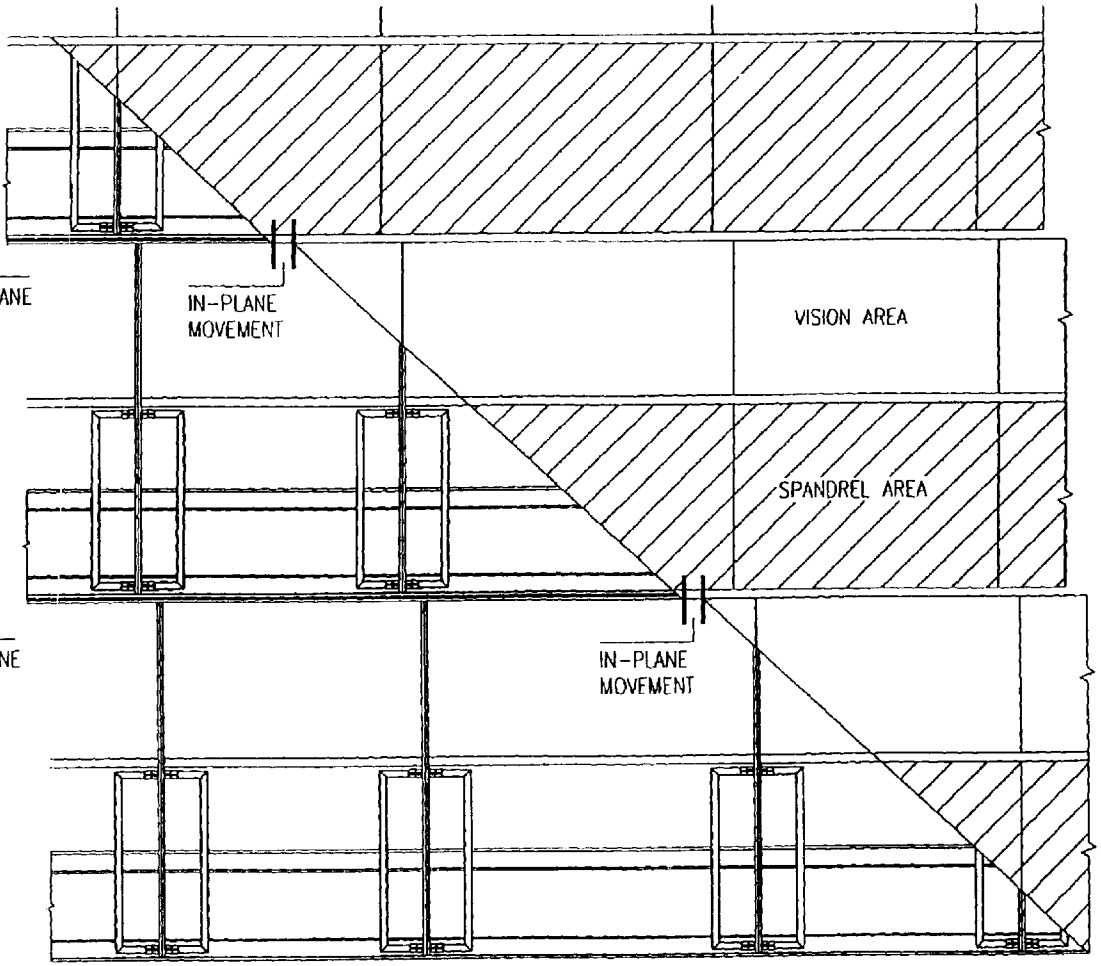
FIG. 13 is a front elevation view showing positions of the curtain wall system during in-plane and out-of-plane interstory movements of the building frame during earthquake conditions.
Figure 14:
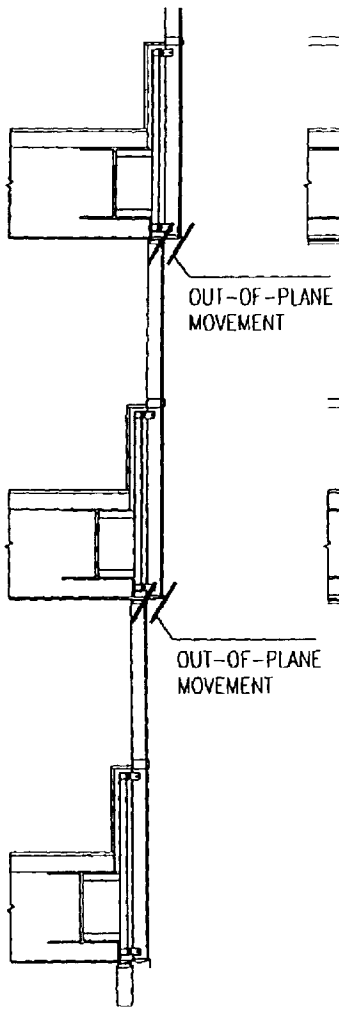
FIG. 14 is a vertical section of that shown in FIG. 13.

FIG. 13 contains a front view and FIG. 14 a vertical section of the earthquake-immune curtain wall system during simultaneous in-plane and out-of-plane interstory movements. (The movements are drawn to an exaggerated scale for clarity and emphasis.) It can be observed that, within the geometric limits designed into a specific version of the earthquake-immune curtain wall system, simultaneous in-plane, out-of-plane, and vertical interstory movements can be accommodated by the system without significant interstory load transfer.

In summary, the seismic decoupler joint 64: (1) accommodates interstory movements in all directions; (2) transfers no significant loads between adjacent stories; and (3) provides an effective thermal insulation and weather seal between adjacent stories in an earthquake-immune curtain wall system.

We claim:

1. An earthquake-immune exterior wall system for use with a multi-story building structure, the wall system comprising:

a plurality of exterior wall panels;

a plurality of structural connectors, each attached to respective for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate seismic decoupler joints each comprising the sole connection between the exterior wall panels on any one story to the exterior wall panels on an adjacent story of the multi-story building structure, each seismic decoupler joint being of one piece and spanning an entire width of the any one story and being mechanically interlocked to the exterior wall panels, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion.

2. The system of claim 1 wherein each elongate seismic decoupler joint comprises a continuous, flexible gasket.

3. The wall system of claim 1 wherein each elongate seismic decoupler joint is removably securable between the exterior wall panels.

4. The wall system of claim 1 wherein each elongate seismic decoupler joint comprises an elongate central portion connected between opposite elongate locking portions, the locking portions for connection to the exterior wall panels.

5. The wall system claim 1 wherein the exterior wall panels comprise precast concrete cladding panels.

6. The wall system of claim 1 wherein the exterior wall panels comprise stone cladding panels.

7. The wall system of claim 1 wherein the exterior wall panels comprise glass panels.

8. The wall system of claim 1 wherein the structural connectors comprise anchor frames.

9. The wall system of claim 1 wherein the exterior wall panels comprise curtain wall panel frames supporting exterior cladding panels.

10. The wall system of claim 1 further comprising an elongate rotation-accommodating face cap operatively secured to a bottom edge of each of the exterior wall panels overlying the seismic decoupler joint.

11. The wall system of claim 1 wherein each elongate seismic decoupler joint comprises an elongate flexible planar element rolled between the exterior wall panels permitting free in-plane, out-of-plane, and vertical interstory movement of the exterior wall panels.

12. An earthquake-immune exterior wall system for use with a multi-story building structure, the wall system comprising:

a plurality of exterior wall panels;

a plurality of structural connectors, each attached to respective ones for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate seismic decoupler joints each comprising the sole connection between the exterior wall panels on any one story to the exterior wall panels on an adjacent story of the multi-story building structure, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion, wherein each elongate seismic decoupler joint comprises a pair of continuous, flexible gaskets, one positioned at a front of the exterior wall panels and the other positioned at a rear of the exterior wall panels.

13. An earthquake-immune exterior wall system for use with a multi-story building structure, the wall system comprising:

a plurality of exterior wall panels;

a plurality of structural connectors, each attached to respective ones for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate seismic decoupler joints each comprising the sole connection between the exterior wall panels on any one story to the exterior wall panels on an adjacent story of the multi-story building structure, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion, wherein each elongate seismic decoupler joint comprises an elongate central portion connected between opposite elongate locking portions, the locking portions for connection to the exterior wall panels and wherein the central portion is generally flat in a natural state and is rolled into position to provide a U-shape between the exterior wall panels, in use.

14. An earthquake-immune exterior wall system for use with a multi-story building structure, the wall system comprising:

a plurality of exterior wall panels;

a plurality of structural connectors, each attached to respective ones for structurally coupling one of the respective exterior wall panels to the building structure for a single story of the multi-story building structure so that a plurality of the exterior wall panels are structurally coupled to each of multiple adjacent stories of the multi-story building structure;

a plurality of elongate seismic decoupler joints each comprising the sole connection between the exterior wall panels on any one story to the exterior wall panels on an adjacent story of the multi-story building structure, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion; and an elongate rotation-accommodating face cap operatively secured to a bottom edge of each of the exterior wall panels overlying the seismic decoupler joint wherein each face cap is hingedly connected to the bottom edge of the one of the exterior wall panels.

15. An earthquake-immune exterior wall system for use with a multi-story building structure, the wall system comprising:

a plurality of exterior wall panels;

a plurality of structural connectors, each attached to respective ones for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate seismic decoupler joint means, each said joint means for flexibly coupling and providing the sole connection between the exterior wall panels on any one story to the exterior wall panels on an adjacent story of the multi-story building structure, each seismic decoupler joint means being mechanically interlocked to the exterior wall panels, the decoupler joint means permitting free in-plane, out-of-plane, and vertical interstory movement of the exterior wall panels on any one story relative to the exterior wall panels on an adjacent story of the multi-story building structure while remaining coupled to the exterior wall panels so that loads are not transferred between the exterior wall panels on any one story to the exterior wall panels on an adjacent story of the multi-story building structure if the building structure undergoes swaying motion.

16. The wall system of claim 15 wherein each elongate seismic decoupler joint means is removably securable between the exterior wall panels.

17. The wall system of claim 15 wherein each elongate seismic decoupler joint means comprises an elongate central portion connected between opposite elongate locking portions, the locking portions for connection to the exterior wall panels.

18. An earthquake-immune exterior wall system for use with a multi-story building structure, the wall system comprising:

a plurality of exterior wall panels;

a plurality of structural connectors, each attached to respective ones for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate seismic decoupler joint means, each said joint means for flexibly coupling and providing the sole connection between the exterior wall panels on any one story to the exterior wall panels on an adjacent story of the multi-story building structure, the decoupler joint means permitting free in-plane, out-of-plane, and vertical interstory movement of the exterior wall panels on any one story relative to the exterior wall panels on an adjacent story of the multi-story building structure while remaining coupled to the exterior wall panels so that loads are not transferred between the exterior wall panels on any one story to the exterior wall panels on an adjacent story of the multi-story building structure if the building structure undergoes swaying motion, wherein each elongate seismic decoupler joint means comprises an elongate central portion connected between opposite elongate locking portions, the locking portions for connection to the exterior wall panels and wherein the central portion is generally flat in a natural state and is rolled into position to provide a U-shape between the exterior wall panels, in use.

19. An earthquake-immune exterior wall system for use with a multi-story building structure, the wall system comprising:

a plurality of exterior wall panels;

a plurality of structural connectors, each attached to respective ones for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate, flexible seismic decoupler joints removably securable using a mechanical interlock to and comprising the sole connection between the exterior wall panels on any one story to the exterior wall panels on an adjacent story of the multi-story building structure, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion.

20. The wall system of claim 19 wherein each elongate seismic decoupler joint comprises an elongate central portion connected between opposite elongate locking portions, the locking portions for connection to the exterior wall panels.

* * * * *

UNITED STATES PATENT AND TRADEMARK OFFICE

CERTIFICATE OF CORRECTION

PATENT NO. : 6,935,077 B2
APPLICATION NO. : 10/628808
DATED : August 30, 2005
INVENTOR(S) : Wulfert et al.

It is certified that error appears in the above-identified patent and that said Letters Patent is hereby corrected as shown below:

Col. 8, line 20, claim 1, should read:

1. An earthquake-immune exterior wall system for use with a multi-story building structure, the wall system comprising:

a plurality of exterior wall panels;

a plurality of structural connectors, each attached to respective ones of the exterior wall panels for structurally coupling the respective exterior wall panels to the building structure for a single story of the multi-story building structure so that a plurality of the exterior wall panels are structurally coupled to each of multiple adjacent stories of the multi-story building structure; and a plurality of elongate seismic decoupler joints each comprising the sole connection between the exterior wall panels on any one story to the exterior wall panels on an adjacent story of the multi-story building structure, each seismic decoupler joint being of one piece and spanning an entire width of the any one story and being mechanically interlocked to the exterior wall panels, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion.

Col. 9, line 10, claim 12, should read:

12. An earthquake-immune exterior wall system for use with a multi-story building structure, the wall system comprising:

a plurality of exterior wall panels;

a plurality of structural connectors, each attached to respective ones of the exterior wall panels for structurally coupling one of the respective exterior wall panels to the building structure for a single story of the multi-story building structure so that a plurality of the exterior wall panels are structurally coupled to each of multiple adjacent stories of the multi-story building structure; and

UNITED STATES PATENT AND TRADEMARK OFFICE

CERTIFICATE OF CORRECTION

PATENT NO. : 6,935,077 B2
APPLICATION NO. : 10/628808
DATED : August 30, 2005
INVENTOR(S) : Wulfert et al.

It is certified that error appears in the above-identified patent and that said Letters Patent is hereby corrected as shown below:

Col. 9, line 10, claim 12, should read (cont'd):

a plurality of elongate seismic decoupler joints each comprising the sole connection between the exterior wall panels on any one story to the exterior wall panels on an adjacent story of the multi-story building structure, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion, wherein each elongate seismic decoupler joint comprises a pair of continuous, flexible gaskets, one positioned at a front of the exterior wall panels and the other positioned at a rear of the exterior wall panels.

Col. 9, line 38, claim 13, should read:

13. An earthquake-immune exterior wall system for use with a multi-story building structure, the wall system comprising:

a plurality of exterior wall panels;

a plurality of structural connectors, each attached to respective ones of the exterior wall panels for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate seismic decoupler joints each comprising the sole connection between the exterior wall panels on any one story to the exterior wall panels on an adjacent story of the multi-story building structure, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion, wherein each elongate seismic decoupler joint comprises an elongate central portion connected between opposite elongate locking portions, the locking portions for connection to the exterior wall panels and wherein the central portion is generally flat in a natural state and is rolled into position to provide a U-shape between the exterior wall panels, in use.

UNITED STATES PATENT AND TRADEMARK OFFICE

CERTIFICATE OF CORRECTION

PATENT NO. : 6,935,077 B2
APPLICATION NO. : 10/628808
DATED : August 30, 2005
INVENTOR(S) : Wulfert et al.

It is certified that error appears in the above-identified patent and that said Letters Patent is hereby corrected as shown below:

Col. 10, line 1, claim 14, should read:

14. An earthquake-immune exterior wall system for use with a multi-story building structure, the wall system comprising:

a plurality of exterior wall panels;

a plurality of structural connectors, each attached to respective ones of the exterior wall panels for structurally coupling one of the respective exterior wall panels to the building structure for a single story of the multi-story building structure so that a plurality of the exterior wall panels are structurally coupled to each of multiple adjacent stories of the multi-story building structure;

a plurality of elongate seismic decoupler joints each comprising the sole connection between the exterior wall panels on any one story to the exterior wall panels on an adjacent story of the multi-story building structure, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion; and an elongate rotation-accommodating face cap operatively secured to a bottom edge of each of the exterior wall panels overlying the seismic decoupler joint wherein each face cap is hingedly connected to the bottom edge of the one of the exterior wall panels.

Col. 10, line 30, claim 15, should read:

15. An earthquake-immune exterior wall system for use with a multi-story building structure, the wall system comprising:

a plurality of exterior wall panels;

a plurality of structural connectors, each attached to respective ones of the exterior wall panels for structurally coupling one of the respective exterior wall panels to the building structure for a single story of the multi-story building structure so that a plurality of the exterior wall panels are structurally coupled to each of multiple adjacent stories of the multi-story building structure; and

UNITED STATES PATENT AND TRADEMARK OFFICE

CERTIFICATE OF CORRECTION

PATENT NO. : 6,935,077 B2
APPLICATION NO. : 10/628808
DATED : August 30, 2005
INVENTOR(S) : Wulfert et al.

It is certified that error appears in the above-identified patent and that said Letters Patent is hereby corrected as shown below:

Col. 10, line 30, claim 15, should read (cont'd):

a plurality of elongate seismic decoupler joint means, each said joint means for flexibly coupling and providing the sole connection between the exterior wall panels on any one story to the exterior wall panels on an adjacent story of the multi-story building structure, each seismic decoupler joint means being mechanically interlocked to the exterior wall panels, the decoupler joint means permitting free in-plane, out-of-plane, and vertical interstory movement of the exterior wall panels on any one story relative to the exterior wall panels on an adjacent story of the multi-story building structure while remaining coupled to the exterior wall panels so that loads are not transferred between the exterior wall panels on any one story to the exterior wall panels on an adjacent story of the multi-story building structure if the building structure undergoes swaying motion.

Col. 10, line 65, claim 18, should read:

18. An earthquake-immune exterior wall system for use with a multi-story building structure, the wall system comprising:

a plurality of exterior wall panels;

a plurality of structural connectors, each attached to respective ones of the exterior wall panels for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate seismic decoupler joint means, each said joint means for flexibly coupling and providing the sole connection between the exterior wall panels on any one story to the exterior wall panels on an adjacent story of the multi-story building structure, the decoupler joint means permitting free in-plane, out-of-plane, and vertical interstory movement of the exterior wall panels on any one story relative to the exterior wall panels on an adjacent story of the multi-story building structure while remaining coupled to the exterior wall panels so that loads are not transferred between the exterior wall panels on any one story to the exterior wall panels on an adjacent story of the multi-story building structure if the building structure undergoes swaying motion, wherein each elongate seismic decoupler joint means comprises an elongate central portion connected between opposite elongate locking portions, the locking portions for connection to the exterior wall panels and wherein the central portion is generally flat in a natural state and is rolled into position to provide a U-shape between the exterior wall panels, in use.

UNITED STATES PATENT AND TRADEMARK OFFICE

CERTIFICATE OF CORRECTION

PATENT NO. : 6,935,077 B2
APPLICATION NO. : 10/628808
DATED : August 30, 2005
INVENTOR(S) : Wulfert et al.

It is certified that error appears in the above-identified patent and that said Letters Patent is hereby corrected as shown below:

Col. 12, line 1, claim 19, should read:

19. An earthquake-immune exterior wall system for use with a multi-story building structure, the wall system comprising:

a plurality of exterior wall panels;

a plurality of structural connectors, each attached to respective ones of the exterior wall panels for structurally coupling one of the respective exterior wall panels to the building structure for a single story of the multi-story building structure so that a plurality of the exterior wall panels are structurally coupled to each of multiple adjacent stories of the multi-story building structure; and a plurality of elongate, flexible seismic decoupler joints removably securable using a mechanical interlock to and comprising the sole connection between the exterior wall panels on any one story to the exterior wall panels on an adjacent story of the multi-story building structure, the decoupler joints permitting free in-plane, out-of-plane, and vertical interstory movement of the exterior wall panels on any one story relative to the exterior wall panels on an adjacent story of the multi-story building structure so that loads are not transferred between the exterior wall panels on any one story to the exterior wall panels on an adjacent story of the multi-story building structure if the building structure undergoes swaying motion.

Signed and Sealed this

Twenty-fifth Day of December, 2007

Jon W. Dudas

JON W. DUDAS
*Director of the United States Patent and Trademark Office*